US006128990A

United States Patent [19]

Drew et al.

[11] Patent Number: 6,128,990

[45] Date of Patent: Oct. 10, 2000

[54] OIL KIT AND METHOD FOR ELIMINATING GLUE BUILD-UP ON SLITTER BLADES

[75] Inventors: Wilbur Drew, Dover; Len Reichenbach, Goffstown, both of N.H.

[73] Assignee: Moore U.S.A. Inc., Grand Island, N.Y.

[21] Appl. No.: 09/084,249

[22] Filed: May 26, 1998

[51] Int. Cl.[7] ..... B26D 7/08

[52] U.S. Cl. ..... 83/168; 83/169

[58] Field of Search ..... 83/168, 169

[56] References Cited

U.S. PATENT DOCUMENTS

| | | | |
|---|---|---|---|
| Re. 35,086 | 11/1995 | Paulson et al. | 83/169 X |
| 532,471 | 1/1895 | Mershon | 83/168 |
| 1,267,610 | 5/1918 | Washburne . | |
| 1,302,414 | 4/1919 | Nerness . | |
| 1,336,239 | 4/1920 | Kinraide | 83/168 X |
| 1,338,157 | 4/1920 | Rains | 83/168 |
| 1,668,433 | 5/1928 | Thomasson . | |
| 2,205,617 | 6/1940 | Coolidge . | |
| 2,554,683 | 5/1951 | Rogers . | |
| 2,895,553 | 7/1959 | De Gelleke . | |
| 3,013,324 | 12/1961 | Robinson . | |
| 3,147,656 | 9/1964 | Kwitek . | |
| 3,460,418 | 8/1969 | Mathe et al. | 83/168 |
| 3,599,518 | 8/1971 | Goettsch | 83/168 X |
| 3,673,903 | 7/1972 | Evans | 83/168 |
| 3,808,922 | 5/1974 | Ohlhoff | 83/168 |
| 5,090,281 | 2/1992 | Paulson et al. | 83/169 X |
| 5,435,217 | 7/1995 | Kato et al. | 83/168 X |
| 5,609,082 | 3/1997 | Kuchta | 83/168 X |
| 5,894,775 | 4/1999 | Brash et al. | 83/168 |

FOREIGN PATENT DOCUMENTS

| | | | |
|---|---|---|---|
| 2802743 | 7/1979 | Germany | 83/168 |
| 3229368 | 2/1984 | Germany | 83/168 |

*Primary Examiner*—M. Rachuba

*Attorney, Agent, or Firm*—Nixon & Vanderhye, P.C.

[57] ABSTRACT

An oil kit and method eliminate glue build-up on slitting blades of a slitting device. The oil kit includes a bracket assembly that is readily attachable an existing slitting device in the vicinity of the slitting blades. The bracket assembly supports a plurality of pad units each supporting a felt pad soaked in oil. The pad units are adjustable such that the oil kit can be customized for any slitting device slitting blade configuration. The felt pads are secured by friction and can be readily removed and resecured in various configurations before requiring re-soaking of the pads.

19 Claims, 2 Drawing Sheets

OIL KIT AND METHOD FOR ELIMINATING GLUE BUILD-UP ON SLITTER BLADES

BACKGROUND OF THE INVENTION

The present invention relates to an oil kit and method for eliminating glue build-up on slitting blades and, more particularly, to an oil kit and method wherein a plurality of pad units are adjustably attached to a bracket assembly for selective positioning into engagement with the slitting blades.

Large rolls of a continuous web of material are typically purchased in large diameters and widths and then slit to the size needed to run particular jobs and to fit into the presses. When the web of material contains an adhesive such as a pressure sensitive material, when cut or slit down to smaller rolls, the adhesive has a tendency to build up on the slitter blades, which adversely affects operation such as by causing continuous jams in the decollator or the like.

In one prior art example, a label material is manufactured in 16" widths, is run through a printer, fan folded, and moved to a decollator with six slitter attachments. The 16" wide label is slit into five individual stacks of labels. During the slitting process, the slitting blades were gumming up with adhesive and causing continuous jams in the decollator.

SUMMARY OF THE INVENTION

It has been discovered that using a lubricant on the slitter blades is helpful to prevent adhesive build-up. It is thus an object of the invention to provide an oil kit and method for continuous application of a lubricant on the slitting blades for preventing glue build-up on the slitting blades.

In accordance with one aspect of the invention, these and other objects of the invention are achieved by providing an oil kit for eliminating glue build-up on slitting blades. The oil kit includes a bracket assembly attachable to a slitting device adjacent the slitting blades. The bracket assembly includes a frame member having a longitudinal slot therein. The oil kit also includes a plurality of pad units adjustably attached to the frame member in the slot. The pad units are adjustable along the longitudinal slot for selective positioning into engagement with the slitting blades.

Each of the pad units preferably includes a pad holder sized to frictionally hold a felt pad, and an attachment member cooperating with the longitudinal slot for attaching the pad units, respectively, to the frame member. Each of the pad holders may include a plurality of bent tabs integral with a main support. In this context, the bent tabs delimit a felt pad holding area, wherein the oil kit further includes a felt pad frictionally and releasably supported in the felt pad holding area. The felt pad is preferably soaked in oil such as 350 centistoke food grade silicon fluid. The main support may include four sides, and the plurality of tabs preferably include one bent tab on each of the four sides of the main support, respectively, extending substantially perpendicular to the main support. The attachment member may be a threaded shaft attached to or integral with the main support and extending through the longitudinal slot including a nut threaded on the threaded shaft.

In accordance with another aspect of the invention, there is provided a slitting device for slitting rolls of a continuous web of material. The slitting device includes a plurality of rotatable slitting blades, and the above oil kit operatively engageable with the slitting plates.

In still another aspect of the invention, there is provided a method of eliminating glue build-up on slitting blades using an oil kit including a plurality of pad units adjustably attached to a bracket assembly secured to a slitter. The method includes the steps of soaking a plurality of felt pads in oil, frictionally securing the felt pads in the pad units, respectively, and adjusting a position of the pad units in the bracket assembly to engage the felt pads with the slitting blades, respectively. The method may further include, after a predetermined operation period, the steps of removing the felt pads from the pad units, rotating the felt pads, and re-securing the pads in the pad units without re-soaking the pads in oil.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
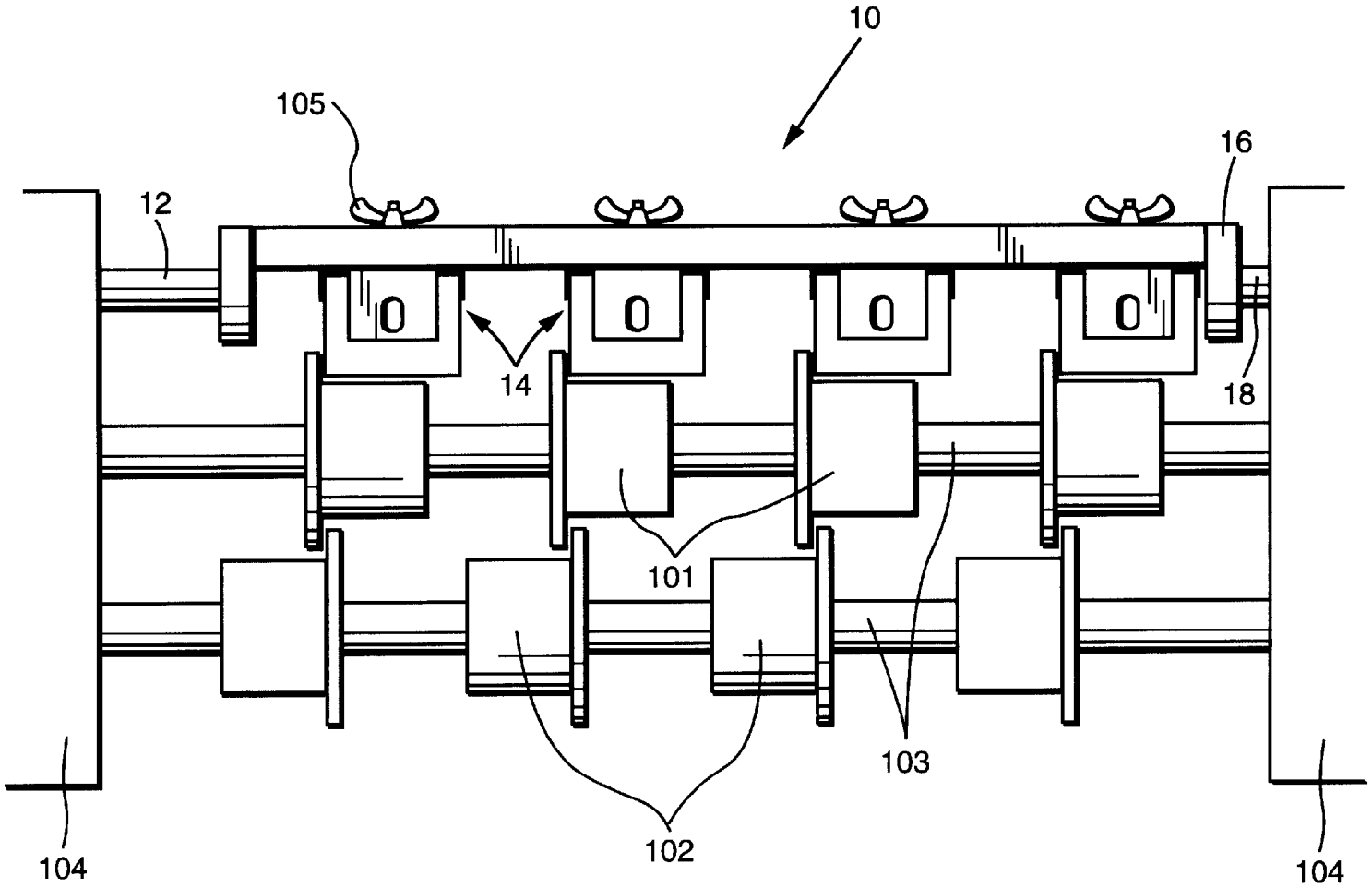
FIG. 1 illustrates a slitting device incorporating the oil kit according to the present invention.

Referring to FIG. 1, the oil kit 10 according to the present invention is shown forming part of a slitting device. The slitting device includes upper slitters 101 and lower slitters 102 mounted for rotation on shafts 103. The shafts 103 are driven by a conventional slitter driving mechanism 104. The details of the structure and operation of the slitting device are not pertinent to the invention and will not be further described. The present invention is suitable for any number of slitting device configurations, and the invention is not meant to be limited to the illustrated example. Conventionally, the slitting device is used to cut or slit rolls of a continuous web of material such as a pressure-sensitive material.

The oil kit 10 according to the invention includes, in general, a bracket assembly 12 attachable to the slitting device adjacent the slitting blades, preferably the upper slitting blades 101, and a plurality of pad units 14 adjustably attached to the bracket assembly 12. In the slitting device, the bracket assembly 12 is attached to a frame of the slitting device in any suitable manner. In a preferred arrangement, one piece of a two-piece split collar 16 is welded to the bracket assembly, and the collar 16 is secured over a slitter support shaft 18. The two pieces of the collar 16 are preferably secured by screws or the like (not shown).

Figure 2:
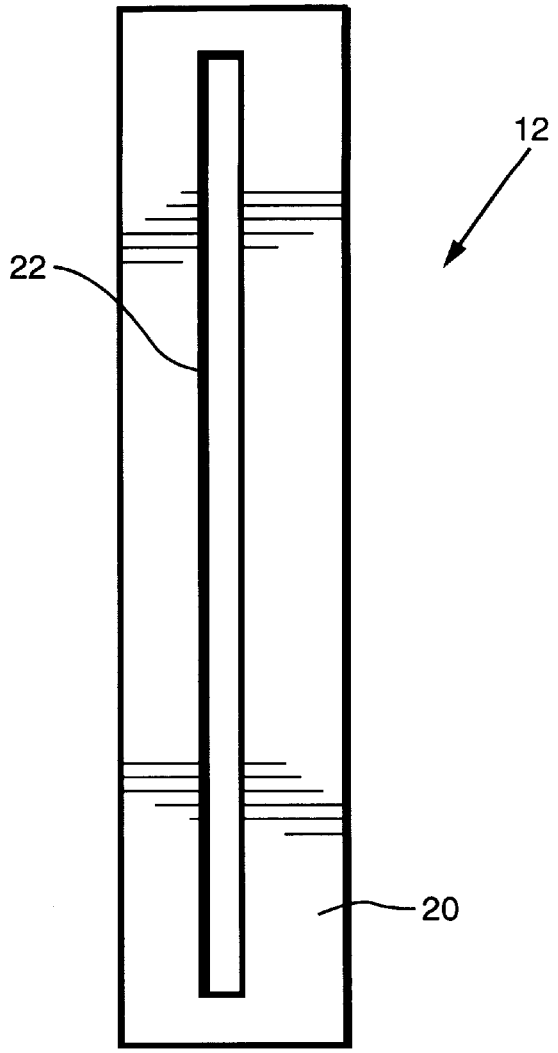
FIG. 2 is a top plan view of the bracket assembly.

Referring to FIG. 2, the bracket assembly 12 includes a frame member 20 including a longitudinal slot 22 therein. The frame member 20 preferably has a length that spans a distance slightly greater than the width of the slitting device to which the oil kit is being provided. The longitudinal slot 22 extends slightly less than the entire length of the frame member 12 preferably over a distance at least equal to the width expanded by the slitting blades of the slitting device. The frame member 20 is preferably blanked from a sheet of 0.048 steel, although other materials and manufacturing methods may be used, and the invention is not meant to be limited to the disclosed material and method.

Figure 3:
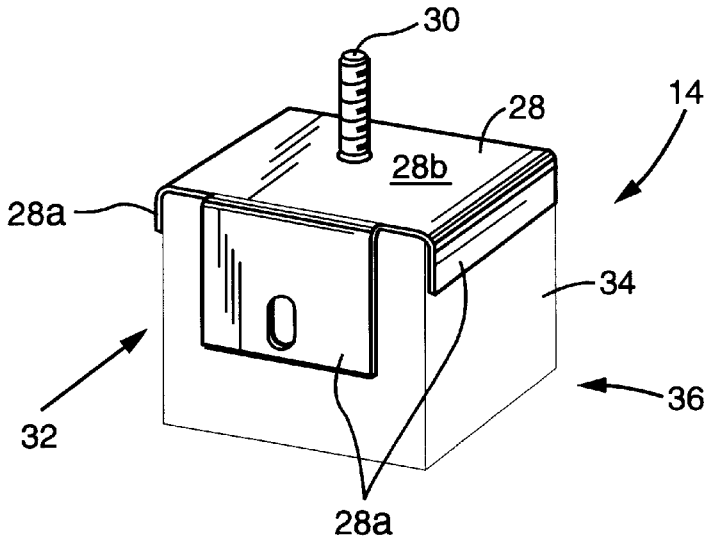
FIG. 3 is a perspective view of a pad unit forming part of the oil kit according to the present invention.

Referring to FIG. 3, each of the pad units 14 includes a pad holder 28 that is sized to frictionally hold a felt pad, and an attachment member 30 such as a threaded shaft or post. In preferred forms, the attachment member 30 extends through the longitudinal slot 22 and is secured with a nut 105 (FIG. 1) such as a wingnut.

The holder 28 includes a plurality of bent tabs 28*a* integral with a main support 28*b*. As shown in FIG. 3, the bent tabs 28*a* delimit a felt pad holding area 32. A felt pad 34 is frictionally and releasably supported in the felt pad holding area by the bent tabs 28*a*. That is, the bent tabs 28*a* extend substantially perpendicular to the main support 28*b*, and the felt pad 34 is held in place by the bent tabs 28*a* by friction. The attachment member 30 is preferably formed integral with the main support 28*b*. At least one of the bent tabs 28*a* includes a hole 35 therein to facilitate re-oiling of the pads 34.

A suitable felt pad is available from Omni Services of Londonderry, New Hampshire. The felt pads are typically provided in 1"×1"×6' and are cut to an appropriate size. The preferred material is 100% wool, its color is generally white, and the pads have a density per volume of water of 0.17–0.20.

In operation, the felt pads are soaked in oil or other suitable lubricant 36 prior to insertion in the pad units 14. With reference again to FIG. 1, the soaked felt pads constantly oil the upper slitter blades, for example. This process eliminates the glue build-up on the blades, which in turn increases the run time of the decollator before maintenance is required.

Discoloration of the paper can be avoided by using, for example, a 350 centistoke food grade oil such as the Dow-Corning 200 Silicon fluid 350 CS. The soak time of a 1"×1"×1½" felt pad is about twenty minutes per set of pads. The soaked pads can be removed from the pad holders 28, rotated in eight different positions (four sides of each end of each pad) before re-soaking in oil is required. To facilitate removal and insertion of the pads 34, the bracket assembly 12 and pad units 14 are configured to flip up for easy access. That is, in a preferred arrangement, the screws or the like securing the two-piece collars 16 to the support shaft 18 can be loosened, enabling the entire assembly to be pivoted.

According to the present invention, an oil kit is provided to constantly oil the upper slitter blades, for example, in a slitting device. The oil kit is readily attachable to conventional slitting devices by providing easily adjustable pad units secured to a bracket assembly. Once installed, the pad units support felt pads soaked in a suitable oil, which pads can be reconfigured numerous times before re-soaking is required.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An oil kit for eliminating glue build-up on slitting blades, the oil kit comprising:

a bracket assembly attachable to a slitting device adjacent the slitting blades, the bracket assembly including a frame member having a longitudinal slot therein; and a plurality of pad units adjustably attached to the frame member in the slot, the pad units each being individually adjustable along the longitudinal slot for selective positioning into engagement with the slitting blades.

2. An oil kit according to claim 1, wherein each of the pad units comprises:

a pad holder sized to frictionally hold a felt pad; and an attachment member cooperating with the longitudinal slot for attaching the pad units, respectively, to the frame member.

3. An oil kit according to claim 2, wherein each of the pad holders comprises a plurality of bent tabs integral with a main support, the bent tabs delimiting a felt pad holding area, the oil kit further comprising a felt pad frictionally and releasably supported in the felt pad holding area.

4. An oil kit according to claim 3, wherein the main support comprises four sides, and wherein the plurality of tabs comprises one bent tab on each of the four sides of the main support, respectively, extending substantially perpendicular to the main support.

5. An oil kit according to claim 3, wherein the attachment member comprises a threaded shaft attached to the main support and extending through the longitudinal slot and a nut threaded to the threaded shaft.

6. An oil kit according to claim 2, wherein the attachment member is integral with the pad holder.

7. An oil kit according to claim 2, further comprising a felt pad frictionally and releasably supported by the pad holder.

8. An oil kit according to claim 7, wherein the felt pad is soaked in oil.

9. An oil kit according to claim 8, wherein the oil is 350 centistoke food grade silicone fluid.

10. A slitting device for slitting rolls of a continuous web of material, the slitting device comprising:

a plurality of rotatable slitting blades; and an oil kit operatively engageable with the slitting blades, the oil kit comprising:

a bracket assembly attached to the slitting device adjacent the slitting blades, the bracket assembly including a frame member having a longitudinal slot therein, and a plurality of pad units adjustably attached to the frame member in the slot, the pad units each being individually adjustable along the longitudinal slot for selective positioning into engagement with the slitting blades.

11. A slitting device according to claim 10, wherein said bracket assembly is pivotally attached to the slitting device.

12. A slitting device according to claim 10, wherein each of the pad units comprises:

a pad holder sized to frictionally hold a felt pad; and an attachment member cooperating with the longitudinal slot for attaching the pad units, respectively, to the frame member.

13. A slitting device according to claim 12, wherein each of the pad holders comprises a plurality of bent tabs integral with a main support, the bent tabs delimiting a felt pad holding area, the slitting device further comprising a felt pad frictionally and releasably supported in the felt pad holding area.

14. A slitting device according to claim 13, wherein the main support comprises four sides, and wherein the plurality of tabs comprises one bent tab on each of the four sides of the main support, respectively, extending substantially perpendicular to the main support.

15. A slitting device according to claim 13, wherein the attachment member comprises a threaded shaft attached to the main support and extending through the longitudinal slot and a nut threaded to the threaded shaft.

16. A slitting device according to claim 12, wherein the attachment member is integral with the pad holder.

17. A slitting device according to claim 12, further comprising a felt pad frictionally and releasably supported by the pad holder.

18. A slitting device according to claim 17, wherein the felt pad is soaked in oil.

19. A slitting device according to claim 18, wherein the oil is 350 centistoke food grade silicone fluid.

* * * * *